US005088667A

United States Patent [19]

Olson

[11] Patent Number: 5,088,667

[45] Date of Patent: Feb. 18, 1992

[54] TRASH BAG HOLDING AND SPREADING DEVICE

[76] Inventor: Ralph C. Olson, 520 Gwynnwest Rd., Reisterstown, Md. 21136

[21] Appl. No.: 558,661

[22] Filed: Jul. 26, 1990

[51] Int. Cl.[5] ..... B65B 67/04

[52] U.S. Cl. ..... 248/101; 248/95; 294/171; 383/13

[58] Field of Search ..... 248/95, 99, 100, 101; 294/171; 383/13

[56] References Cited

U.S. PATENT DOCUMENTS

| | | | |
|---|---|---|---|
| 2,078,438 | 4/1937 | Baxter | 150/1 |
| 2,875,970 | 3/1959 | Gardner | 248/101 |
| 3,091,422 | 5/1963 | Hobbs | 248/101 |
| 3,162,414 | 12/1964 | Maschek | 248/101 |
| 3,253,593 | 5/1966 | Cronin, Jr. | 248/95 X |
| 3,561,077 | 2/1971 | Grant | 248/95 |
| 3,861,630 | 1/1975 | Ady | 248/100 |
| 3,893,649 | 7/1975 | Cornell et al. | 248/99 |
| 3,912,140 | 10/1975 | Franges | 294/171 X |
| 3,912,208 | 10/1975 | Grenetier | 248/99 |
| 3,942,832 | 3/1976 | Haas, Jr. | 294/55 |
| 3,998,415 | 12/1976 | D'Antonio et al. | 248/101 |
| 4,112,541 | 9/1978 | Tetradis | 383/13 X |
| 4,159,139 | 6/1979 | Gawedzinski | 294/55 |
| 4,339,099 | 7/1982 | Barton et al. | 248/101 |
| 4,550,440 | 10/1985 | Rico | 248/99 |
| 4,705,249 | 11/1987 | Edwards | 248/101 |
| 4,773,585 | 9/1988 | Lehrman | 248/99 X |
| 4,827,566 | 5/1989 | Richins | 383/13 X |
| 4,858,781 | 8/1989 | Kane et al. | 248/95 X |
| 4,871,264 | 10/1989 | Robbins, III et al. | 383/13 X |

FOREIGN PATENT DOCUMENTS

| | | | |
|---|---|---|---|
| 1220139 | 1/1971 | United Kingdom | 248/99 |
| 2202135 | 9/1988 | United Kingdom | 294/171 |

*Primary Examiner*—David L. Talbott
*Assistant Examiner*—Daniel Hulseberg
*Attorney, Agent, or Firm*—Leonard Bloom

[57] ABSTRACT

A unitary one-piece holder for removably retaining and spreading open a trash bag. The holder includes a pair of retainer halves, each of which has a respective internal face, first adjoining edge that adjoin one another and second remote edge. The halves are joined together along the respective adjoining edges thereof by at least one hinge. The halves are pivotable about the hinge in a first closed direction and in a second open direction. In the first direction, the remote edges and the internal faces are moved toward one another for closing the device with a "snap-action" and clamping at least a portion of the bag therebetween, so that the bag is at least partially spread open. In the second direction, the remote edges and the internal faces are moved away from one another for opening the device and unclamping and releasing the trash bag from therebetween. Means are provided carried by the halves for removably securing the retainer halvew to one another for removably closing the device with the "snap-action" when the halves are moved in the first direction.

24 Claims, 7 Drawing Sheets

TRASH BAG HOLDING AND SPREADING DEVICE

FIELD OF THE INVENTION

The present invention relates to devices for holding and spreading open at least a portion of a trash bag and, in particular, to a unitary one-piece device for removably holding and spreading open at least a portion of a trash bag.

BACKGROUND OF THE INVENTION

Recent environmental awareness has resulted in a recognition of, and an increase in, the recycling of various waste products. In order to facilitate such recycling, it is necessary to provide separate waste receptacles for the various waste materials to be recycled, such as plastics, aluminum cans, green glass, brown glass, clear glass, paper and food (or garbage). Thus, five or six separate waste receptacles are often required.

The necessity of providing so many receptacles often results in such recycling efforts not being pursued in places where available space is limited, such as in the home, in recreational or camping vehicles, etc.

This space problem is further compounded by the fact that, often institutions (such as elementary schools) that accept such waste for recycling only do so during certain limited periods, necessitating the further use of space.

Moreover, when working around the lawn or garden, problems are often encountered in putting leaves, twigs or debris into a trash bag. In such instances, it is usually necessary to have one person hold and spread the mouth of the bag open, while a second person puts the leaves, twigs or debris into the bag. Thus, this becomes a "three-handed" job, that is difficult for one person to handle.

In order to solve the above problems, various mechanical devices have been disclosed that are designed to hold (and/or spread), or to aid in holding (and/or spreading) a trash bag open. Such devices of which I am aware have been disclosed in the following United States Patents:

| Inventor(s) | U.S. Pat. No. | Year of Issue |
|---|---|---|
| Baxter | 2,078,438 | 1937 |
| Gardner | 2,875,970 | 1959 |
| Hobbs | 3,091,422 | 1963 |
| Maschek | 3,162,414 | 1964 |
| Ady | 3,861,630 | 1975 |
| Cornell et al | 3,893,649 | 1975 |
| Grenetier | 3,912,208 | 1975 |
| Haas, Jr. | 3,942,832 | 1976 |
| D'Antonio et al | 3,998,415 | 1976 |
| Gawedzinski | 4,159,139 | 1979 |
| Barton et al | 4,339,099 | 1982 |

I am also aware of a device that consists of a sectional rectangular frame including plastic PVC piping. The trash bags are then clipped onto the frame (as, for example, one bag for aluminum, another for brown glass, another for plastic, etc.).

While each of the above devices aid in making the chore a "two-handed" job that can be performed by one person, these devices have, unfortunately, all proven to be unsatisfactory in several respects. First, these devices routinely employ large wire frames and plastic or metal barrels that typically receive the bag and which spread and hold the mouth of the bag open, so that trash can be placed therein. Such frames and barrels can be overly expensive and are often too large to be conveniently stored in many households. Secondly, such devices often require considerable time and effort to properly arrange the trash bag therein. Thirdly, other of these devices are often complicated, being comprised of a number of elements (such as springs) which may be easily lost or damaged.

Further, it is noted that none of the devices noted above satisfactorily combines durability with portability, so that the device may be utilized "in the field".

Accordingly, it can be seen that there remains a need for a device for holding at least a portion of a trash bag and spreading open the trash bag, so that the device occupies minimum amounts of space (cubic footage) and further so that filling of the trash bag is a "two-handed" or a "one-handed" job, and wherein the device is a highly durable unitary one-piece device that is lightweight so as to be portable, low-cost, easy-to-use, and which does not have any loose parts or elements which may be lost or damaged.

SUMMARY OF THE INVENTION

Accordingly, it is an object of the present invention to provide a trash bag holder comprising a one-piece unitary device for holding at least a portion of a trash bag and for facilitating placing trash into the bag.

It is another object of the present invention to provide a trash bag holder that occupies a minimum of space and may be used easily and conveniently, so as to encourage and facilitate the recycling of various forms of waste products.

It is yet another object of the present invention to provide a trash bag holder which is durable and portable, so as to encourage and facilitate its widespread use in the home, lawn and garden, and a variety of applications.

It is a further object of the present invention to provide a trash bag holder that is easily mountable to (and removable from) a support, such as a wall or door.

It is a still further object of the present invention to provide a trash bag holder that permits a single user to fill the trash bag with only one or two hands.

It is a yet still further object of the present invention to enable a full bag of trash or garbage to be handled conveniently and easily, thereby obviating the necessity for a vertical lifting of a trash bag or garbage bag out of a garbage can.

In accordance with the teachings of the present invention, a trash bag holder is disclosed for a trash bag that includes an opening having a peripheral edge. The trash bag holder is a unitary member that includes a pair of complementary mating halves that are joined together at an integral "living" hinge intermediately of the member. Means is carried by each of the mating halves for cooperative locking engagement therebetween. In this manner, when the mating halves are pivoted together about their integral hinge, the mating halves join together with a "snap action". Further in this manner, the mating halves may be easily pulled apart. Means is also provided for engaging a portion of the peripheral edge of the trash bag between the mating halves of the trash bag holder when the mating halves thereof are brought together. In this manner, the trash bag is supported by the trash bag holder and depends therefrom. The remaining portion of the peripheral edge of the trash bag tends to fold down upon the bag.

and the remaining portion of the peripheral edge of the trash bag may be lifted away form the trash bag holder for the purpose of putting trash into the bag.

In a preferred embodiment, the portability of the trash bag holder of the present invention is facilitated by the provision of an opening in each of the mating halves substantially centrally thereof. The respective openings in the mating halves communicate with one another when the mating halves are joined together for forming a grip for the trash bag holder. In this manner, the trash bag holder and the trash bag supported thereon may be carried easily and conveniently.

In accordance with the further teachings of the present invention, a unitary one-piece device is provided for removably retaining at least a portion of a trash bag having an open end bounded by an edge and for spreading the bag open for the filling thereof. This device includes a pair of retainer halves. Each retainer half has a respective internal face and a respective external face. Each half further has a respective first adjoining edge that adjoin one another and a respective second remote edge opposite to the first edges. The halves are joined together along the respective adjoining edges thereof by at least one hinge. The halves are pivotable about the hinge in a first closed direction and in a second opposite open direction. In the first closed direction, the remote edges and the internal faces of the halves are moved towards one another for closing the device and clamping therebetween at least a portion of the bag near the open end thereof. In this fashion, the bag is spread and held substantially open. In the second opposite direction, the remote edges and the internal faces of the halves are moved away from one another for opening the device and unclamping and releasing the trash bag from therebetween. The retainer halves further have means for removably securing the retainer halves to one another for closing the device with at least a portion of the trash bag clamped therebetween. This means is carried by the retainer halves, so that when the halves are moved in the first direction, the means are engaged for closing the device; and when the halves are moved in the second direction, the means are disengaged for opening the device.

Preferably, the means for removably securing the retainer halves to one another includes each half having respective substantially parallel ribs formed thereon. The ribs of one of the halves has longitudinal protuberances formed thereon, and the ribs of the other of the halves have longitudinal slots formed therein. The slots and the protuberances are sized and shaped to cooperate with one another, so that each slot receives therein a respective protuberance, whereby the two retainer halves are removably secured to one another.

The above-described device of the present invention retains approximately half (or a substantial portion) of the circumferential edge or lip at the opening of the bag, so that the bag is held and spread open. With half of the bag circumference or periphery so retained, the remaining half of the bag circumference usually hangs down against the retainer (to partially close the bag). However, when a user wishes to place something into the bag, the person merely uses one hand to pull the remaining half of the bag circumference away from the retainer to thereby open the bag. Thereafter, using the other hand, the user may place the trash into the opening at the top of the bag.

Additionally, the trash bag holder of the present invention is ideally suited for gathering leaves and in working around the lawn and garden.

These and other objects of the present invention will become readily apparent from a reading of the following specification and claims, taken in conjunction with the enclosed drawings.

BRIEF DESCRIPTION OF THE DRAWINGS

FIGS. 8–15 illustrate various uses of the trash bag holder of the present invention.

FIG. 8 illustrates the portability and convenience of the trash bag holder of the present invention, wherein a trash bag (with some waste material therein) is supported by the holder, and wherein additional trash may be placed in the open bag, thereby eliminating a "three-handed" approach.

FIG. 9 illustrates the use of a plurality of trash bag holders in a typical home recycling center.

FIG. 10 illustrates the use of the trash bag holder in a camper.

FIG. 11 illustrates the use of the holder on a boat.

FIG. 12 illustrates the use of the holder at a patio, deck, campsite or picnic site.

FIG. 13 illustrates the use of the holder in a yard for the removal of leaves, wherein a user is placing items in the trash bag while holding the bag open with only one hand.

FIG. 14 illustrates the use of the holder in the household.

DESCRIPTION OF PREFERRED EMBODIMENTS

Figure 1:
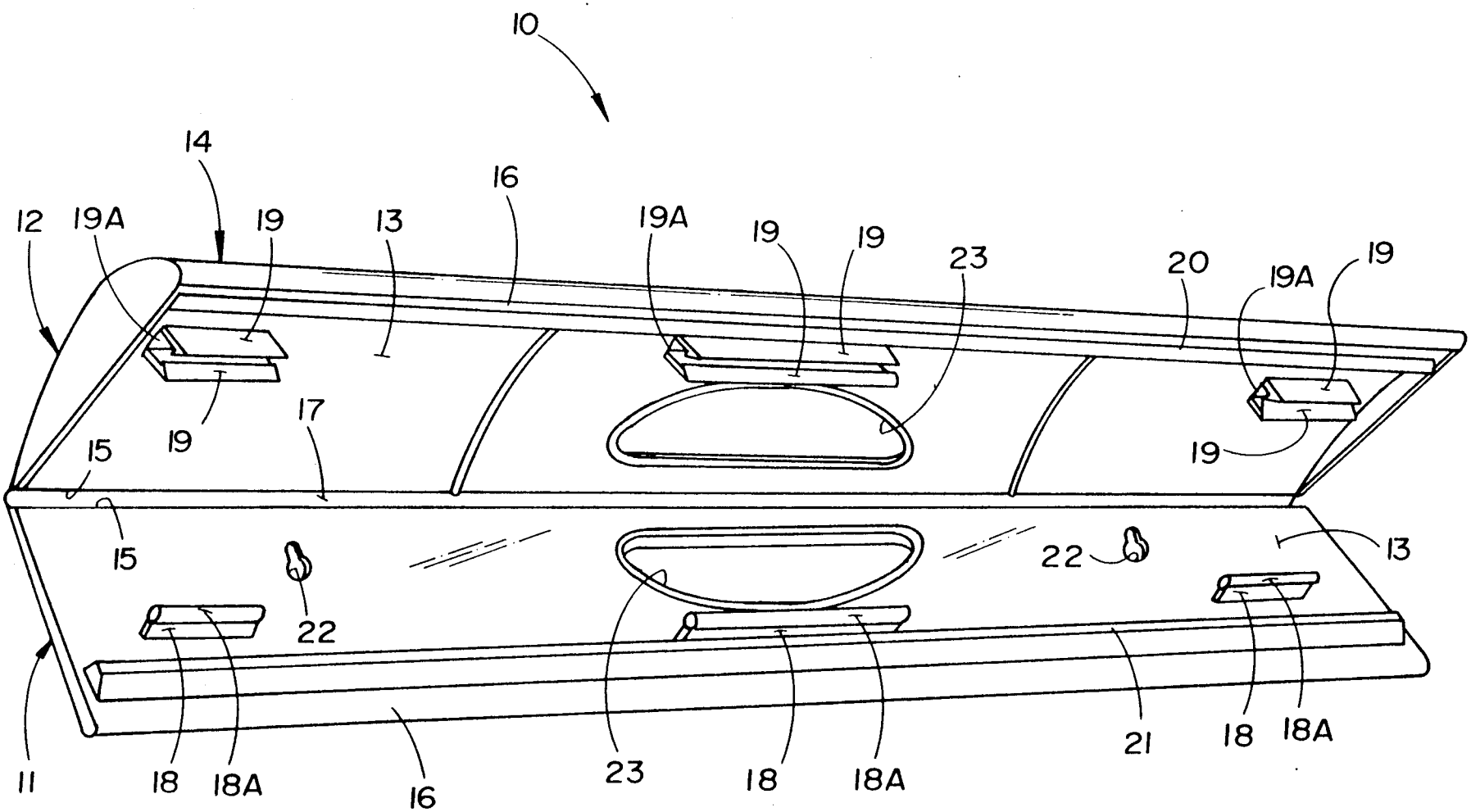
FIG. 1 is a perspective view of the one-piece trash bag holder of the present invention in a partially open position, showing the two integral mating halves thereof spaced from one another.
Figure 2:
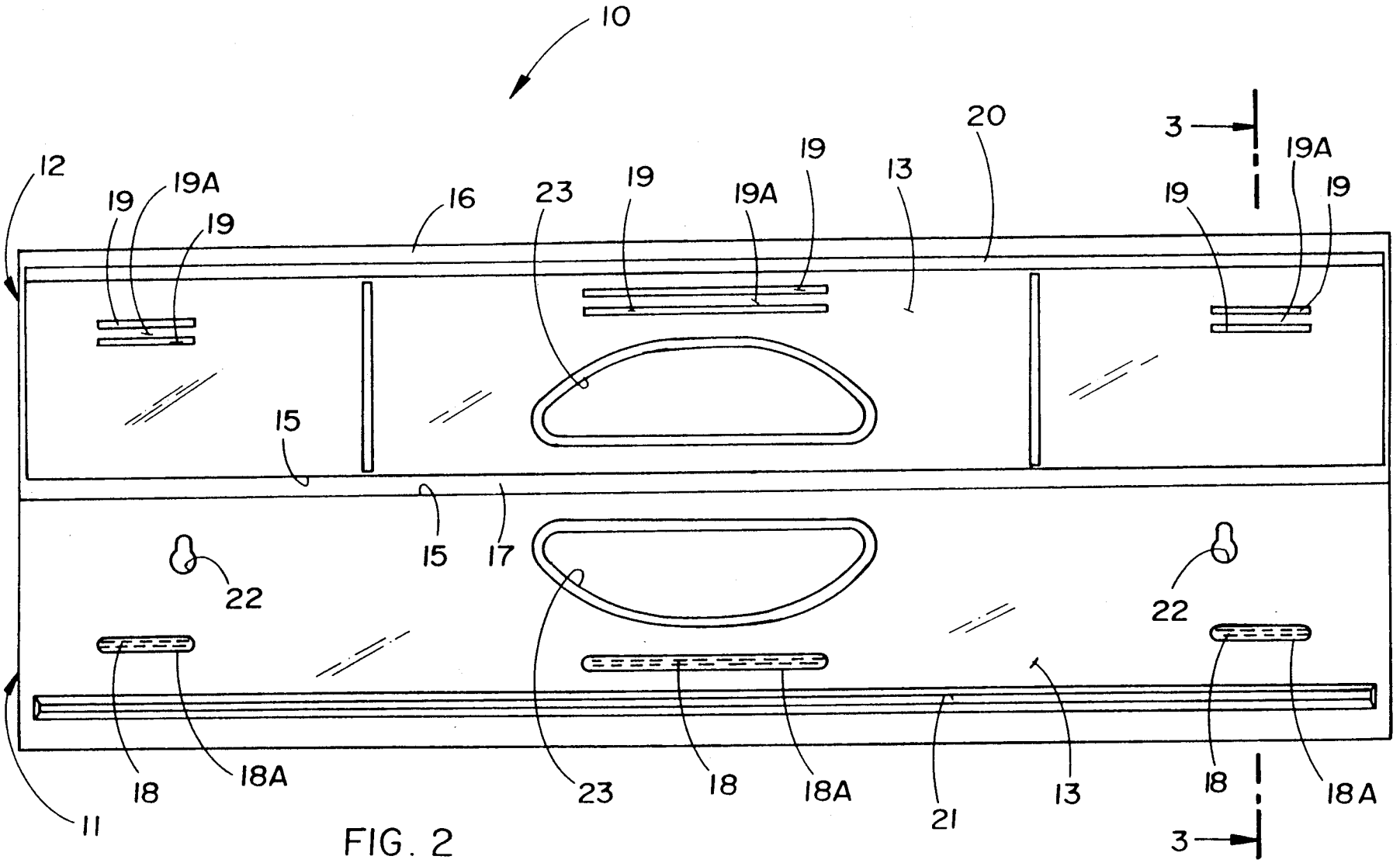
FIG. 2 is a top view of the trash bag holder in a completely open position, showing the internal faces of the mating halves and the means for removably securing the halves to one another for closing the holder.
Figure 3A:
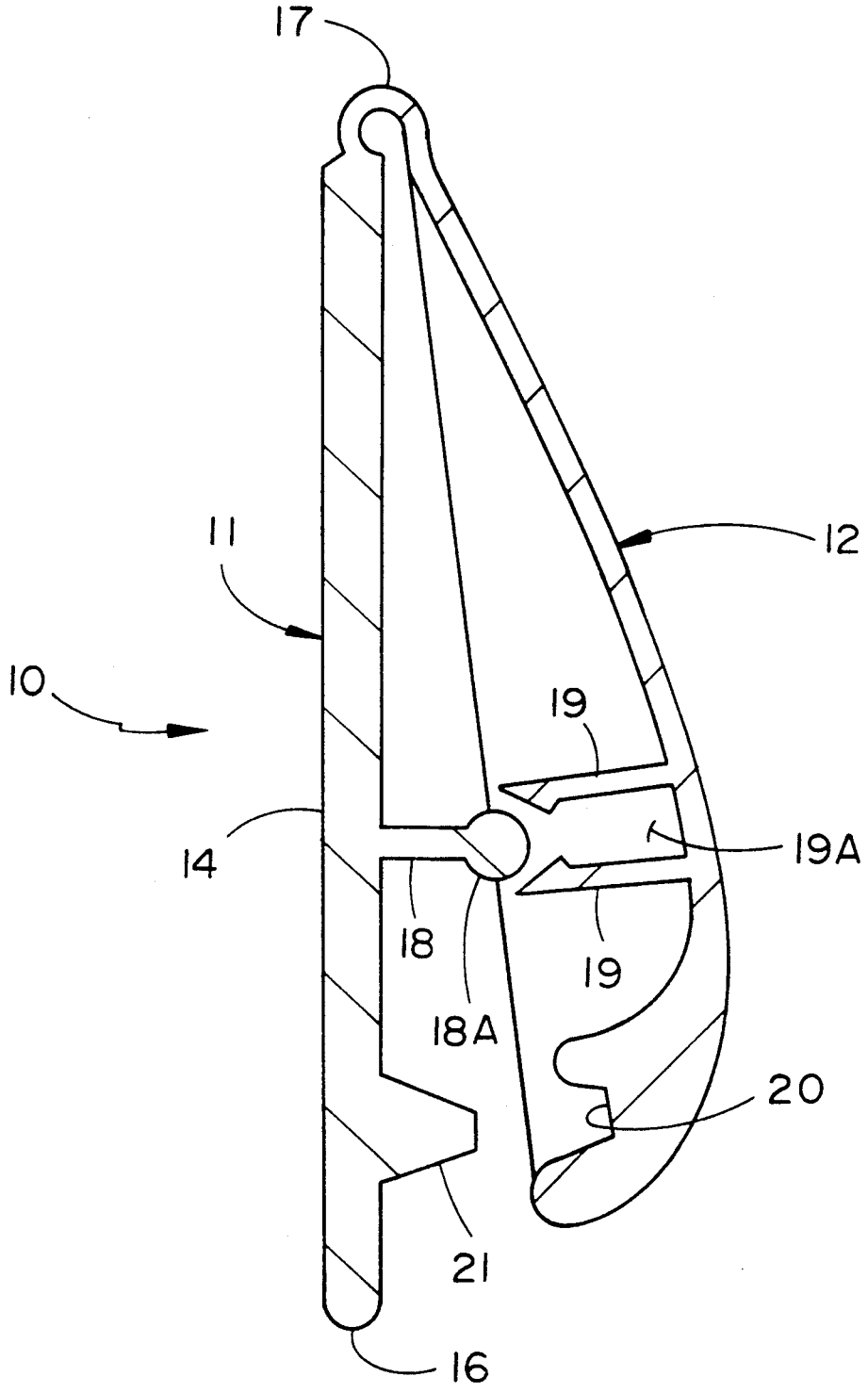
FIG. 3A is a further cross-sectional view (inverted from the showing in FIG. 3) and illustrating the closure of the cover portion of the trash bag holder with respect to the supporting base portion thereof.
Figure 3:
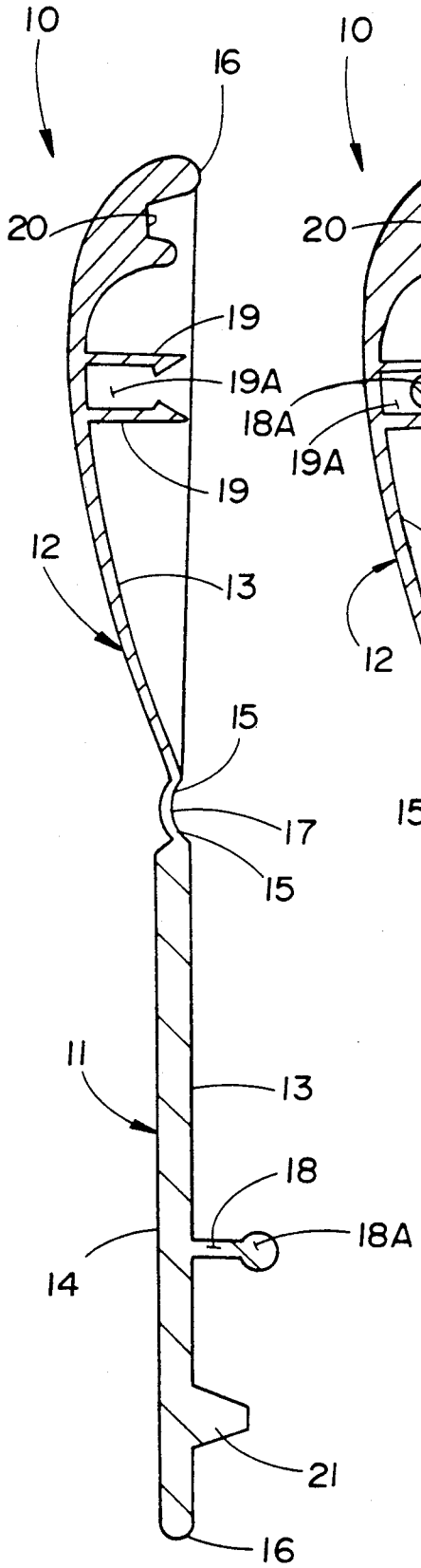
FIG. 3 is a cross-section view thereof, taken along lines 3—3 of FIG. 2.

Referring to the drawings, the trash bag holder 10 of the present invention is a unitary member or article constituting a one-piece device. Preferably, the holder 10 is a single integrally molded plastic piece that is formed by injection molding. The holder 10 may be made in different sizes for use in various places (such as in a camper, on a boat, or in the home) as well as spaces of different dimensions.

With particular reference to FIGS. 1–7, the holder 10 includes a pair of complementary mating (retainer) halves 11 or portions and 12 constituting a supporting base portion 11 and a movable cover portion 12. Preferably, and as shown in the drawings, the cover 12 is curved outwardly and convexly with respect to the base portion 11. Each of the mating halves 11 and 12 has a respective internal face 13, a respective external face 14, and respective longitudinal side edges. Each half 11 and 12 further has a respective first adjoining edge 15 (that adjoin one another) and respective second remote edges 16 that are opposite to the first edges 15.

The halves 11 and 12 of the holder 10 are joined together along the respective adjoining edges 15 thereof by at least one hinge 17. Preferably (but not necessarily) only one hinge 17 is utilized, and this hinge 17 is an intermediate integral hinge that extends along substantially the entire length of the adjoined edges 15 of the respective mating halves 11 and 12. If desired, however, a plurality of hinges 17 may be provided that are spaced along the adjoining edges 15.

Preferably, all such hinges 17 are formed integrally with both the halves 11 and 12. Additionally, it is preferred that all such hinges 17 are of the type having flexibility (resiliency) and plastic memory. Such hinges 17 are commonly referred to as a "living hinge".

Formed in the manner described above, the halves 11 and 12 are pivotable about the hinge 17 in a first closed direction and in a second opposite open direction. When the halves 11 and 12 are moved in the first direction, the remote edges 16 and the internal faces 13 of the halves 11 and 12 are moved towards one another for closing the holder and clamping therebetween at least a portion of the bag 1 near the edge of the open end thereof. In this manner, the bag is held substantially open. When the halves 11 and 12 are moved in the second opposite direction, the remote edges 16 and the internal faces 13 of the halves 11 and 12 are moved away from one another for opening the holder 10 and unclamping and releasing the trash bag 1 from therebetween.

Figure 4A:
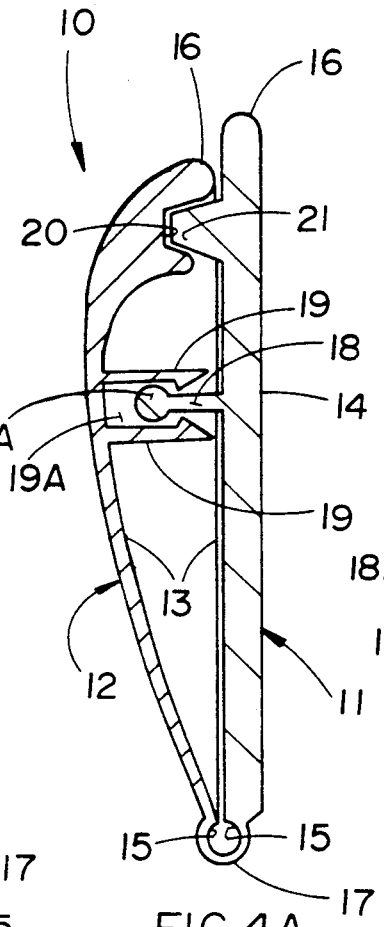
FIG. 4A is a further cross-section view corresponding substantially to FIG. 3, but showing the trash bag holder in a completely closed position.
Figure 4B:
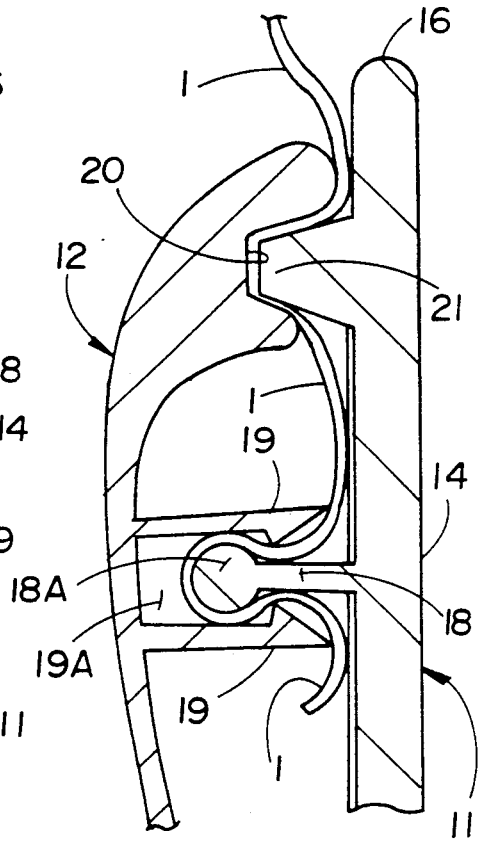
FIG. 4B is an enlarged portion of FIG. 4A, but showing a portion of a trash bag clamped between the cooperating mating halves of the integral one-piece trash bag holder.
Figure 5:
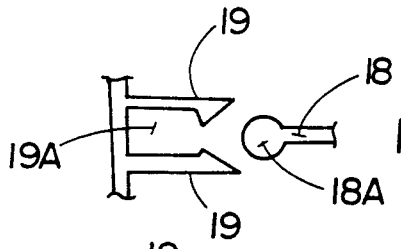
FIGS. 5–7 are schematic sequence views, showing a preferred embodiment of the means for removably securing the mating halves together.
Figure 6:
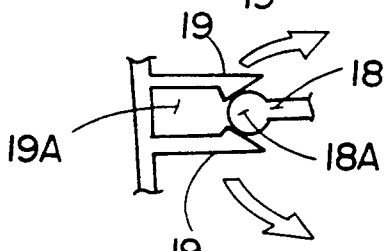
Figure 7:
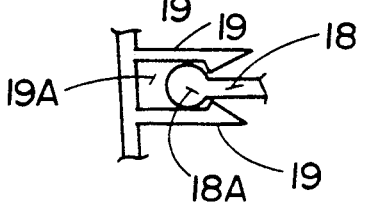

With particular reference to FIGS. 4A, 4B and 7, the retainer halves 11 and 12 further have means carried thereby for cooperative locking engagement therebetween for removably securing the retainer halves 11 and 12 to one another for closing the holder 10 with at least a portion of the bag clamped therebetween. This means includes the respective internal faces 13 of each half 11 and 12 having respective substantially parallel longitudinal ribs 18 and 19, respectively, formed thereon. Each rib 18 of the mating half 11 has a spherically-formed longitudinal protuberance 18 formed thereon. Each rib 19 of the mating half 12 is spaced apart to form a resilient longitudinal slot 19A formed therein. The slots 19A and the protuberances 18A are sized and shaped to cooperate with one another, so that each slot 19A receives a respective protuberance 18A therein. In this fashion, when the halves 11 and 12 are moved in a first direction (FIG. 5) the protuberances 18A engages the ribs 19, so that further movement of the halves 11 and 12 in the first direction pushes the ribs 19 outwardly in the direction of the arrows (FIG. 6) and the protuberances 18A are received in the slots 19A. The ribs 19 then snap shut substantially surrounding the protuberances 18A, so that the protuberances 18A are engaged in the slots 19A for closing and removably securing the halves 11 and 12 to one another (FIG. 7). In this respect, it is noted that when the mating halves 11 and 12 are pivoted about their integral hinge 17 in the first direction, the mating halves 11 and 12 join together with a "snap action".

Further in this fashion and due to this "snap action" arrangement, when the halves 11 and 12 are moved in the second direction, the protuberances 18A are easily removed (disengaged) from the slots 19A for opening the device.

Thus, it will be appreciated (from an examination of FIGS. 3, 3A, 4A and 4B) that the parallel ribs 19 and the protuberance 18A cooperate therebetween to provide (in addition to the detent "snap action" locking means) a first positioning or locating means between the cover half 12 and the base 11 and, in effect, aligning the respective halves or portions of the trash bag holder 10. Moreover, as shown in the drawings, the end portions of the parallel ribs 19 are beveled so as to facilitate entry of the protuberance 18A between the ribs 19 to effect a smooth closure of the holder 10. Moreover, and as shown more particularly in FIGS. 2 and 3, the first means (elements 18, 18A, 19, 19A) are longitudinally spaced within the holder 10, and constitute three sets of locking means in a preferred embodiment of the present invention.

Referring again to FIGS. 1, 2 and 4B, second retention means are provided for engaging a portion of the peripheral edge of the trash bag 1 between the mating halves 11 and 12 of the holder 10 when the mating halves 11 and 12 are joined together. Preferably, this means includes a longitudinal rib 21 on mating half 11 and cooperating with a longitudinal recess 20 formed on the mating half 12. The longitudinal rib 21 on mating half 11 extends substantially the full length of the mating half 11 and is substantially adjacent to the remote edge 16 of the half 11 (as shown more clearly in FIGS. 1 and 2) and the longitudinal recess 20 on the mating half 12 also extends substantially the full length of the mating half 12 and substantially adjacent to the remote edge 16 thereof.

As shown in the drawings, the first locking means (elements 18, 18A, 19, 19A) is intermediately of the integral "living" hinge 17 and the second retention means and engaged prior to the engagement of the second retention means (elements 18, 18A, 19, 19A) for the bag 1.

Accordingly, when the mating halves 11 and 12 are moved in the first direction, so as to be placed in the closed (clamping) position (with, preferably, a "snap-action") a portion of the peripheral edge of the trash bag 1 is clamped between the mating halves 11 and 12, as shown more clearly in FIG. 4B. Preferably, the peripheral edge of the bag 1 is clamped not only between the rib 21 and recess 20, but also between the protuberances 18A and slots 19A. Such a clamping action provides added strength that is desirable for effective support of the trash bag 1 (and its contents) by the holder 10, so that the bag depends therefrom. Clamped in this manner, the remaining portion of the peripheral edge of the trash bag 1 tends to fold down upon the bag 1; however, the opening in the trash bag 1 is still relatively accessible to the user, so that trash may be inserted within the trash bag 1 with one hand. This may be accomplished whether the trash bag holder 10 is supported on a wall (or other support) or is held by one hand of the user.

The trash bag holder 10 of the present invention may be removably or permanently secured to a wall (or other suitable support) as may be desired by the user. In one embodiment, the trash bag holder 10 of the present invention further includes means for removably securing the holder 10 to a support 2 having a nail, hook or other similar structure extending substantially outwardly therefrom; so that the holder 10 and the bag 1 depending therefrom is supported on a wall or other rigid structure. This means includes at least one of the halves 11 (or 12) having an opening 22 formed therein. In this fashion, the nail or hook of the support 2 may be received through the opening 22 for removably supporting the holder 10 on the support 2.

Preferably, openings 22 are keyhole-shaped openings 22. With such keyhole-shaped openings 22, the trash bag holder 10 may be removably placed on and lifted off (removed from) the nails or hooks as desired and/or needed.

Figure 8:
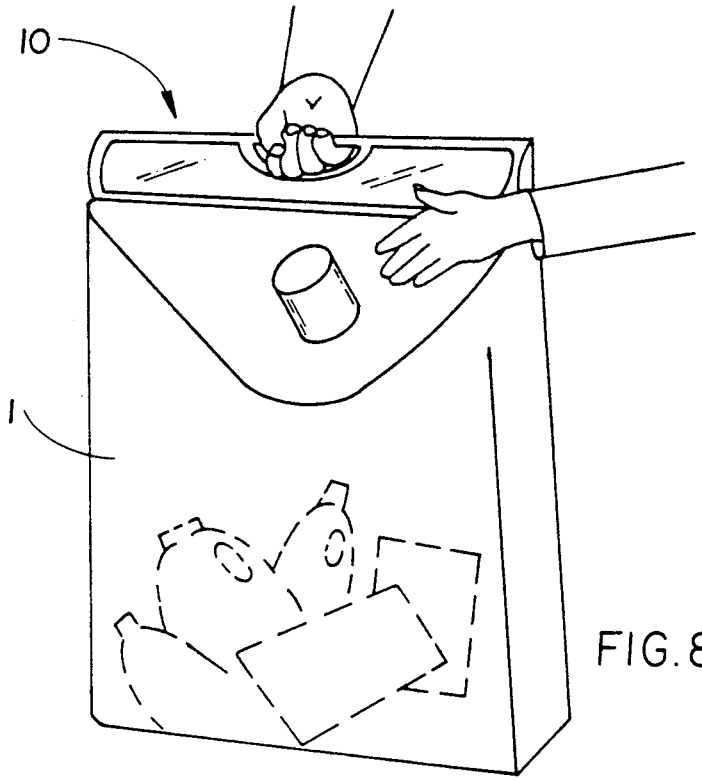

Finally, it is further preferred that the halves 11 and 12 include means for removably gripping the halves 11 and 12. Preferably, this means includes a hand opening 23 formed in each of the mating halves 11 and 12, respectively, and substantially centrally thereof. When the mating halves 11 and 12 are secured together (as described above) the openings 23 communicate with one another to form a hand grip. In this fashion, each half 11 (or 12) may be easily gripped for manually pivotally moving the half 11 (or 12) in either the first or second directions; and when the halves 11 and 12 are snapped together, the trash bag holder 10 (and the trash bag 1 retained thereby) may be carried easily and conveniently, as shown in FIG. 8.

Figure 9:
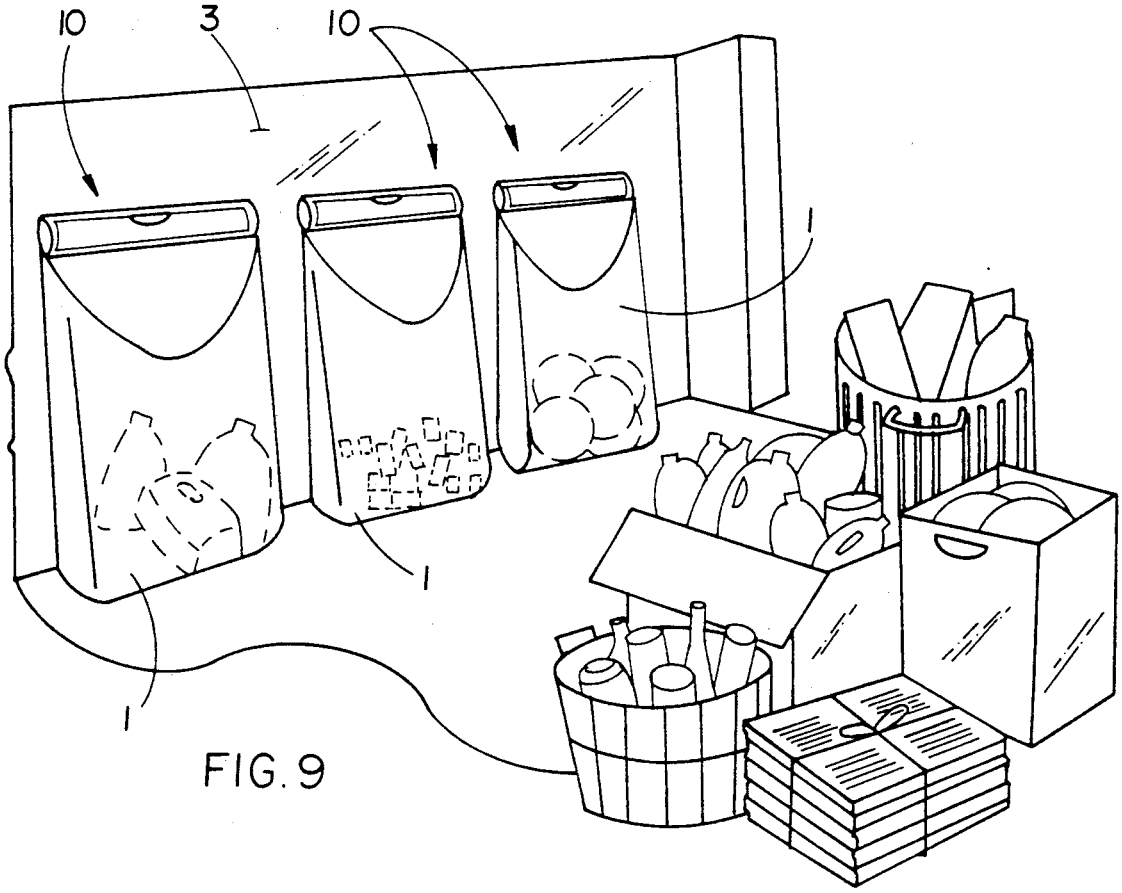
Figure 10:
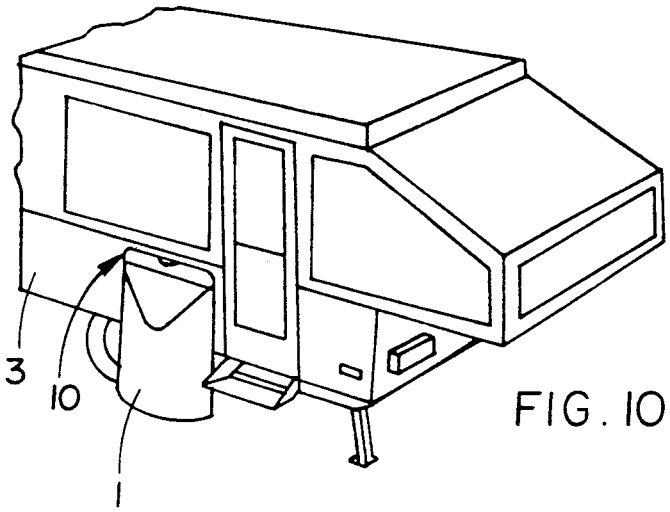
Figure 11:
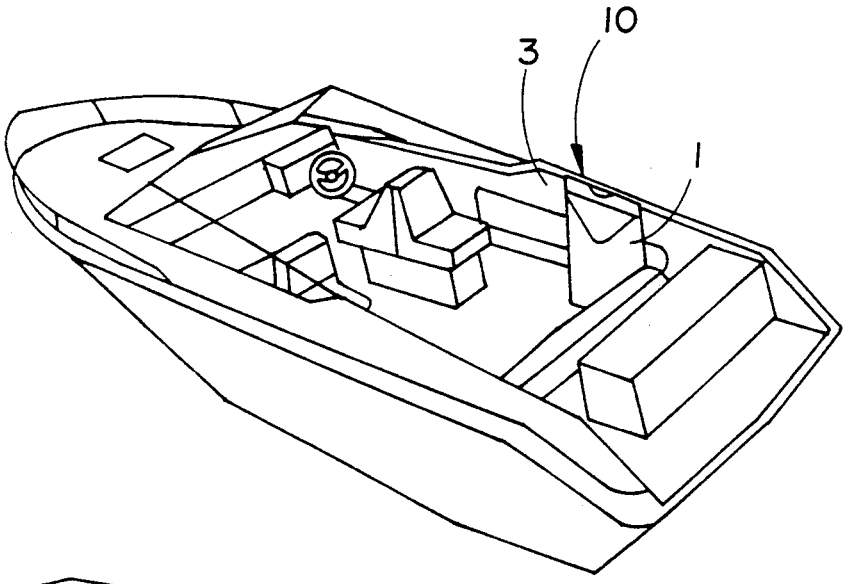
Figure 12:
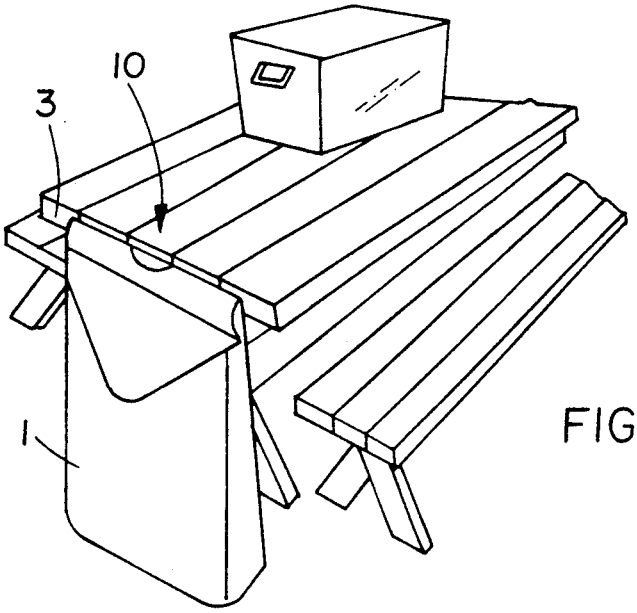
Figure 13:
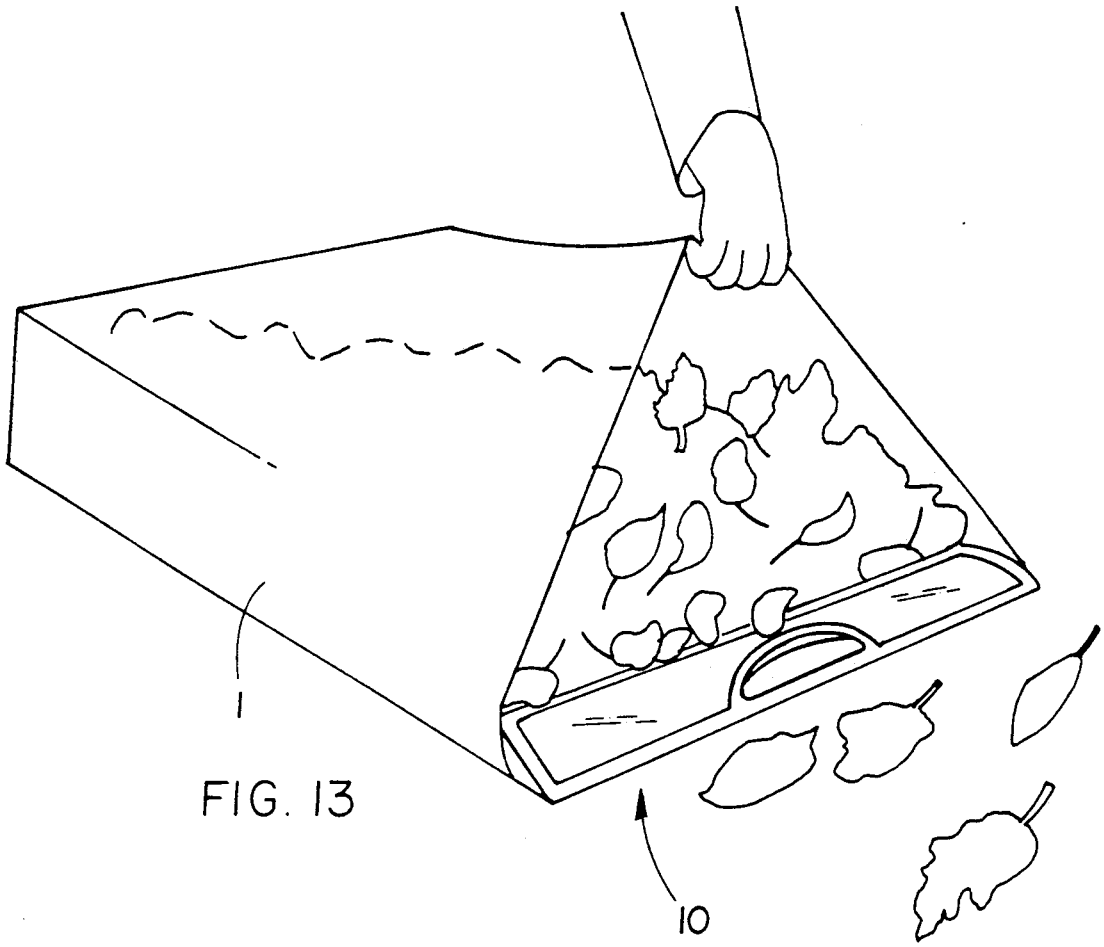
Figure 14:
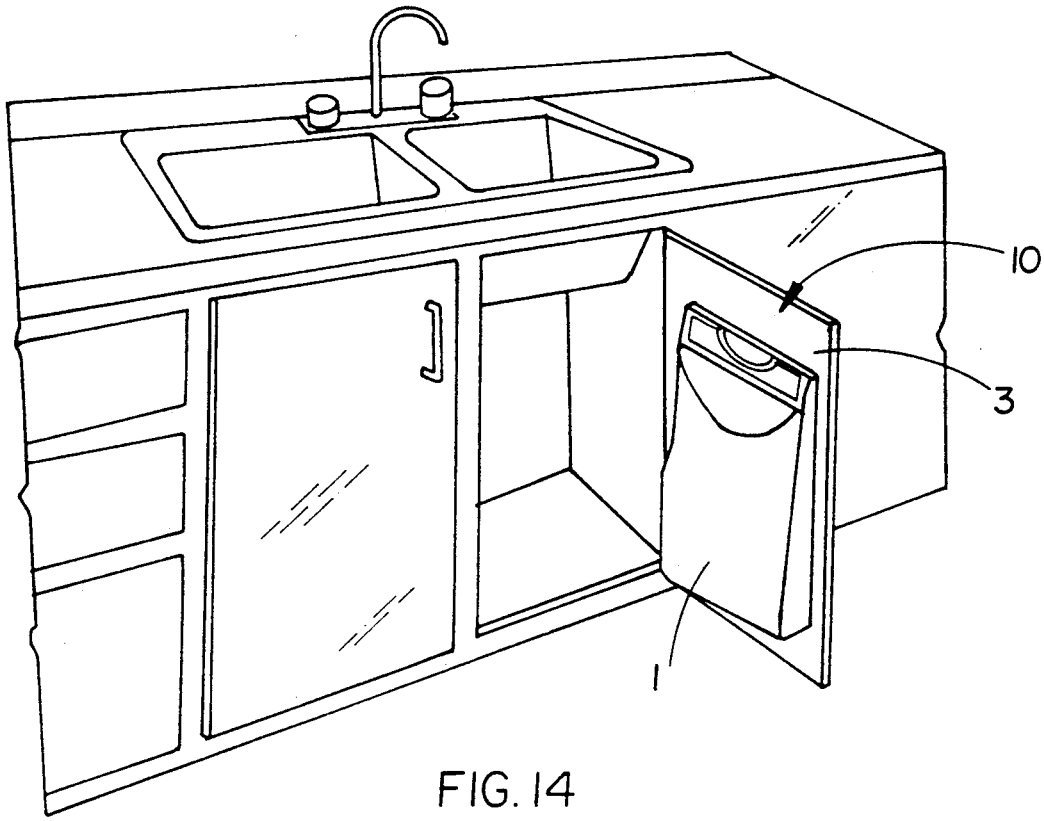

The trash bag holder 10 of the present invention is useful for a variety of different applications and in a variety of different locations. As noted above, its size and shape may be varied as needed and/or desired for particular applications such as the gathering and collection of trash (FIGS. 8–12 and 14–15) or leaves (FIG. 13), etc. in various particular locations, such as in a home recycling center (FIG. 9), in a camper (FIG. 10), on a boat (FIG. 11) at a picnic site (FIG. 12), in the yard (FIG. 13) or in the home as, for example, an "under-the-sink" unit (FIG. 14) or a home recycling center (FIG. 15).

As can be seen in FIGS. 9–15, the holder 10 engages one end of the bag while the remainder of the edge just hangs down. The holder 10 is designed to be attached to (or be removably secured to) a support 2, such as a wall (FIGS. 8, 10, 11 and 14) or a picnic table (FIG. 12) by, for example, being clipped on hooks. When secured to the support 2, the bag 1 is at a height that permits the bottom of the bag 1 to rest upon the floor or a deck. This provides the holder 10 with further strength and stability because the weight of the bag is shifted from the hooks or clamps. When so positioned, the unclamped part of the bag 1 may merely be grabbed and pulled away, so that the bag 1 may be filled with the appropriate waste material.

Although the size and shape of the holder 10 may be varied as needed or desired, nevertheless, the length of the holder 10 in a preferred embodiment will be approximately twenty (20) inches. In this respect it is noted that large trash bags (for lawn collection, etc.) have a circumference of approximately sixty (60) inches, so that the diameter is a little less than twenty (20) inches.

Use of the holder 10 eliminates the need for lifting of trash bags 1 out of garbage cans and, indeed, may eliminate the need for garbage cans altogether.

Finally, if desired, the various trash bag holders utilized according to the present invention may be color-coded with or without a label (either stuck on or molded therein) to identify the category of waste material to be placed therein.

As will be appreciated, the holder 10 provides an elegant technical solution to a problem of long-standing duration that has been consistently recognized by the references cited above. This holder 10, being a single unitary-molded plastic piece, is attractive in appearance and easy-to-use. Further, the holder 10 has a relatively low manufacturing cost and does not contain extraneous elements or parts which may become lost or damaged through the use thereof.

Obviously, many modifications may be made without departing from the basic spirit of the present invention. For example, the mating portions or holders of the trash bag holder 10 may be molded separately (rather than integrally) if desired. Accordingly, it will be appreciated by those skilled in the art that within the scope of the appended claims, the invention may be practiced other than has been specifically described herein.

What is claimed is:

1. A trash bag holder for a trash bag, wherein the trash bag includes an opening having a peripheral edge, comprising a unitary article having an open position and a closed position and including a pair of complementary mating portions joined together at an integral "living" hinge intermediately of the article, the mating portions comprising a base portion and a cover portion having respective longitudinal side edges in juxtaposition to each other when the article is in its closed position, first locking means carried by each of the mating portions for cooperative locking engagement therebetween, such that when the mating portions are pivoted together about their integral hinge, the mating portions join together with a "snap action", and such that the mating portions may be easily pulled apart, and second retention means for engaging at least a portion of the peripheral edge of the trash bag between the mating portions of the trash bag holder when the mating portions thereof are joined together, such that the trash bag is supported by the trash bag holder and depends therefrom, the first locking means being disposed between the hinge and the second retention means and comprising a plurality of longitudinally-spaced protuberance means on one of the portions and cooperating with a corresponding plurality of longitudinally-spaced recess means on the other portion, thereby providing a positioning of the portions therebetween as the portions are brought from their open position into their closed position, and the second retention means comprising a longitudinal rib means on one of the portions, spaced inwardly from the respective longitudinal side edge of the one portion thereof, and cooperating with a longitudinal recess means on the other portion spaced inwardly from the respective longitudinal side edge of the other portion.

2. The trash bag holder of claim 1, further including means on the base member for supporting the trash bag holder and the trash bag depending therefrom upon a wall or other rigid structure.

3. The trash bag holder of claim 1, wherein each of the mating portions has an opening formed therein substantially centrally thereof, the respective openings in the mating portions communicating with one another when the mating portions are joined together, thereby forming a hand grip for the trash bag holder, and such that the trash bag holder and the trash bag supported thereon may be carried easily and conveniently.

4. A trash bag holder for a trash bag, wherein the trash bag includes an opening having a peripheral edge, comprising a unitary article having an open position and a closed position and including a pair of complementary mating portions joined together at an integral "living" hinge intermediately of the article, the mating portions comprising a base portion and a cover portion having respective longitudinal side edges in juxtaposition t each other when the article is in its closed position, first locking means carried by each of the mating portions for cooperative locking engagement therebetween, such that when the mating portions are pivoted together about their integral hinge, the mating portions join together with a "snap action", and such that the mating halves may be easily pulled apart, and second retention means for engaging a portion of the peripheral edge of the trash bag between the mating halves of the trash bag holder when the mating halves thereof are joined together, such that the trash bag is supported by the trash bag holder and depends therefrom, the first locking means being disposed between the hinge and the second retention means and comprising a plurality of longitudinally-spaced protuberance means on one of the portions and cooperating with a corresponding plurality of longitudinally-spaced recess means on the other portion, thereby providing a positioning of the portions therebetween as the portions are brought from their open position into their closed position, and the second retention means comprising a longitudinal rib means on one of the portions, spaced inwardly from the respective longitudinal side edge of the one portion thereof, and cooperating with a longitudinal recess means on the other portion spaced inwardly from the respective longitudinal side edge of the other portion, and further including means on the base member for supporting the trash bag holder and the trash bag depending therefrom upon a wall or other rigid structure; and wherein each of the mating portions has an opening formed therein substantially centrally thereof, the respective openings in the mating portions communicating with one another when the mating portions are joined together, thereby forming a hand grip for the trash bag holder, and such that the trash bag holder and the trash bag supported thereon may be carried easily and conveniently.

5. The trash bag holder of claim 4, wherein the first locking means further comprises a plurality of longitudinally-spaced ribs on the base portion of the article, each of the ribs having an end provided with a protuberance thereon, and a corresponding plurality of longitudinally-spaced rib pairs on the cover portion of the article, each of which rib pairs includes first and second spaced parallel ribs having respective ends which are beveled outwardly to receive and guide the respective protuberance on the end portion of the ribs on the base portion, thereby facilitating a piloting of the cover portion as the cover portion is closed upon the base portion of the unitary article.

6. A unitary one-piece device for removably retaining and spreading open at least a portion of a trash bag having an open end bounded by an edge, the device comprised of:

a pair of retainer halves, each half having a respective internal face and a respective external face, each half further having a respective first adjoining edge that adjoin one another and a respective second remote edge opposite to the first edges, the halves being joined together along the respective adjoining edges thereof by at least one hinge, the halves being pivotable about the hinge in a first closed direction, wherein the remote edges and the internal faces of the halves are moved towards one another for closing the device and clamping therebetween at least a portion of the bag near the edge of the open and thereof, so that the bag is held substantially open, the halves further being pivotable about the hinge in a second opposite open direction, wherein the remote edges and the internal faces of the halves are moved away from one another for opening the device and unclamping and releasing the trash bag from therebetween; and the retainer halves further having a first locking means comprising a plurality of protuberance means on one of the halves and cooperating with a corresponding plurality of longitudinally-spaced recess means on the other portion, thereby providing a piloting of the halves therebetween as the halves are brought from their open position into their closed position, the halves further having a second retention means comprising a longitudinal rib means on one of the halves, spaced inwardly from the respective remote edge of the one half thereof, and cooperating with a longitudinal recess means on the other half spaced inwardly from the respective remote edge thereof, and the first locking means being disposed between the hinge and the second retention means.

7. The device of claim 6, wherein the halves are joined together by an intermediate integral "living" hinge.

8. The device of claim 7, wherein the "living" hinge has a flexibility and memory.

9. The device of claim 8, wherein the halves are joined together by a single "living" hinge that extends along substantially the entire adjoined edges.

10. The device of claim 6, wherein the first locking means further comprises a plurality of longitudinally-spaced ribs on one of the halves of the device, each of the ribs having an end provided with a protuberance thereon, and a corresponding plurality of longitudinally-spaced rib pairs on the cover portion of the article, each of which rib pairs on the other half, each of which rib pairs includes first and second spaced parallel ribs having respective ends which are beveled outwardly to receive and guide the respective protuberance on the end portion of the ribs on the one half, thereby facilitating a piloting of the one half as the one half is closed upon the other half of the unitary device.

11. The device of claim 10, wherein the respective ribs and rib pairs are formed on the respective internal faces of the two halves.

12. The device of claim 11, further including means for securing the device to a support having a nail or hook extending outwardly therefrom.

13. The device of claim 12, wherein the means for securing the device to a support includes at least one of the two retainer halves having an opening formed therein, such that the nail or hook of the support may be received therethrough for removably supporting the device on the support.

14. The device of claim 13, wherein the opening is a keyhole-shaped opening.

15. The device of claim 6, wherein the halves includes means for the manual gripping thereof, so that said halves may be manually pivotally moved in either the first or the second directions.

16. A unitary one-piece device for removably retaining and spreading open at least a portion of a trash bag having an open end bounded by an edge, the device comprised of:

a pair of retainer haves, each half having a respective internal face and a respective external face, each half further having a respective first adjoining edge that adjoin one another and a respective second remote edge opposite to the first edges, the halves being joined together along the respective adjoining edges thereof by an intermediate integral "living" hinge having a flexibility and memory, the halves being pivotable about the hinge in a first closed direction, wherein the remote edges and the internal faces of the halves are moved towards one anther for closing the device and clamping therebetween at least a portion of the bag near the edge of the open end thereof, s that the ba is held substantially open, the haves further being pivotable about the hinge in a second opposite open direction, wherein the remote edges and the internal faces of the halves are moved away from one another for opening the device and unclamping and releasing the trash bag from therebetween; and the retainer halves further having a first locking means comprising a plurality of protuberance means on one of the halves and cooperating with a corresponding plurality of recess means on the other portion, thereby providing a piloting of the halves therebetween as the halves are brought from their open position into their closed position, the retainer halves further having a second retention means comprising a longitudinal rib means on one of the halves, spaced inwardly from the respective remote edge of the one half thereof, and cooperating with a longitudinal recess means on the other half spaced inwardly from the respective remote edge thereof, and the first locking means being disposed between the hinge and the second retention means.

17. A unitary one-piece device for removably retaining and spreading open at least a portion of a trash bag having an open end bounded by an edge, the device comprised of:

a pair of retainer halves, including a base half and a cover half, each half having a respective internal face and a respective external face, each half further having a respective first adjoining edge that adjoin one another and a respective second remote edge opposite to the first edges, the halves being joined together along the respective adjoining edges thereof by an intermediate integral "living" hinge having a flexibility and memory, the halves being pivotable about the hinge in a first closed direction, wherein the remote edges and the internal faces of the halves are moved towards one another for closing the device and clamping therebetween at least a portion of the bag near the edge of the open end thereof, so that the bag is held substantially open, the halves further being pivotable about the hinge in a second opposite open direction, wherein the remote edges and the internal faces of the halves are moved away from one another for opening the device and unclamping and releasing the trash bag from therebetween; the halves further having a first locking means comprising a plurality of protuberance means on one of the halves and cooperating with a corresponding plurality of recess means on the other half, thereby providing a piloting of the halves therebetween as the halves are brought from their open position into their closed position, the halves further having a second retention means comprising a longitudinal rib means on one of the halves, spaced inwardly from the respective remote edge of the one half thereof, and cooperating with a longitudinal recess means on the other half spaced inwardly from the respective remote edge thereof, and the first locking means being disposed between the hinge and the second retention means.

18. The device of claim 17, further rcomprised of at least one of the two retainer halves having an opening formed therein for receiving therethrough a nail or hook extending outwardly from a support, such that the device is removably secured to the support.

19. In combination with a trash bag having a peripheral edge, a trash bag holder comprising a pair of mating portions having respective longitudinal edges, means for bringing the mating portions together in a direction transversely of the longitudinal edges of the trash bag holder such that at least a portion of the periphery of the trash bag is retained between the mating portions of the holder without piercing the bag, and such that the remaining portion of the trash bag folds down against the trash bag holder, and a hand grip on the trash bag holder, such that the trash bag holder and the trash bag retained thereon may be carried easily and conveniently, the portions further having a first locking means comprising a plurality of protuberance means on one of the portions and cooperating with a corresponding plurality of recess means on the other portion, thereby providing a piloting of the portions therebetween as the respective portions are brought from their open position into their closed position, the portions further having a second retention means comprising a longitudinal rib means on one of the portion, spaced inwardly from the respective remote edge of the one portions thereof, and cooperating with a longitudinal recess means on the other portion spaced inwardly from the respective remote edge thereof, and the first locking means being disposed between the hinge and the second retention means.

20. The combination of claim 19, wherein the hand grip comprises each of the mating portions having an opening formed therein, and the openings communicating with one another when the halves are brought together.

21. The combination of claim 19, wherein the mating portions of the trash bag holder comprise mating halves of an integrally-molded unitary article, and wherein the mating halves are joined together by an integral hinge therebetween, such that the mating halves may be pivoted together to clamp at least a portion of the periphery of the trash bag therebetween.

22. The combination of claim 19, wherein means are provided for supporting the trash bag holder on a wall or other support, such that the trash bag and the contents therein may rest upon the floor or other surface.

23. In a trash bag holder for a trash bag, wherein the bag has an opening bounded by a peripheral edge, and wherein the holder comprises an integrally-molded unitary article having an open position and a closed position and further comprises a pair of mating portions constituting a base portion and a cover portion joined together intermediately by an integral flexible hinge, the improvement which comprises retention means carried by the baser portion and cover portion, respectively, and remote from the hinge for retaining the peripheral edge of the trash bag at the opening thereof when the holder is in its closed position, and positioning means carried by the base portion and cover portion, respectively, and between the hinge and retention means for piloting the cover portion on to the base portion as the portions are brought together towards the closed position of the holder, the positioning means further providing a locking of the cover portion to the base portion with a "snap action" therebetween and with the same manual movement in closing the holder, thereby obviating the necessity for a separate locking member or a separate manual movement to retain the cover portion to the base portion of the holder.

24. The improvement of claim 23, wherein the cover portion has a wall curved outwardly of the base portion and convexly thereof, such that in the closed position of the holder, the cover portion exerts a component force which is substantially transversly o the base portion, thereby assisting the retention means in retaining the trash bag.

* * * * *

UNITED STATES PATENT AND TRADEMARK OFFICE

CERTIFICATE OF CORRECTION

PATENT NO. : 5,088,667

DATED : February 18, 1992

INVENTOR(S) : OLSON

It is certified that error appears in the above-identified patent and that said Letters Patent is hereby corrected as shown below:

In the Abstract, line 18, change "halvew" to --halves--.

Column 6, line 40, change "engaged" to --engages--.

Column 9, line 5, change "t" to --to--.

Column 10, line 4, change "and" to --end--;

line 34, after "single" and before "living", insert --integral--.

Column 11, line 3, change "haves" to --halves--;

line 14, change "anther" to --another--;

line 16, change "s that the ba" to --so that the bag--;

line 17, change "haves" to --halves--.

Column 12, line 11, change "rcomprised" to --comprised--;

line 21, change "holder" to --holder,--;

line 67, change "baser" to --base--.

Column 14, line 7, change "o" to --of--.

Signed and Sealed this

Thirty-first Day of August, 1993

Bruce Lehman

*Attest:*

*Attesting Officer*

BRUCE LEHMAN

*Commissioner of Patents and Trademarks*